US010706769B2

(12) United States Patent
Shen et al.

(10) Patent No.: US 10,706,769 B2
(45) Date of Patent: Jul. 7, 2020

(54) DISPLAY PANEL AND DISPLAY DEVICE

(71) Applicant: WUHAN TIANMA MICRO-ELECTRONICS CO., LTD., Wuhan (CN)

(72) Inventors: Yang Shen, Wuhan (CN); Tao Peng, Wuhan (CN); Yongzhi Wang, Shanghai (CN); Yingjie Chen, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 15/928,043

(22) Filed: Mar. 21, 2018

(65) Prior Publication Data

US 2018/0211586 A1 Jul. 26, 2018

(30) Foreign Application Priority Data

Nov. 21, 2017 (CN) ..... 2017 1 1167885

(51) Int. Cl.
*G09G 3/30* (2006.01)
*G09G 3/3208* (2016.01)

(52) U.S. Cl.
CPC ..... *G09G 3/30* (2013.01); *G09G 3/3208* (2013.01); *G09G 2300/0426* (2013.01)

(58) Field of Classification Search
CPC ..... G09G 3/30; G09G 3/3208
See application file for complete search history.

(56) References Cited

U.S. PATENT DOCUMENTS

2013/0300965 A1* 11/2013 Nonaka ..... G02F 1/133514 349/42

FOREIGN PATENT DOCUMENTS

CN 105511152 A 4/2016
CN 205334901 U 6/2016

* cited by examiner

*Primary Examiner* — Kenneth Bukowski
(74) *Attorney, Agent, or Firm* — Kilpatrick Townsend & Stockton, LLP

(57) ABSTRACT

The disclosure discloses a display panel and a display device, and there is at least one abnormally shaped region in a display region of the display panel, and sub-pixels located in the abnormally shaped region are arranged in a step-like distribution, where at least opening regions of sub-pixels at the edges of the steps have a deflection angle of more than 0 degree and less than 180 degrees relative to opening regions of sub-pixels which are not located at the steps.

16 Claims, 11 Drawing Sheets

DISPLAY PANEL AND DISPLAY DEVICE

CROSS-REFERENCE TO RELATED APPLICATIONS

This application claims the priority to Chinese Patent Application No. 201711167885.4, filed on Nov. 21, 2017, the content of which is hereby incorporated by reference in its entirety.

FIELD

The present disclosure relates to the field of displays, and particularly to a display panel and a display device.

BACKGROUND

With the development of display technologies, an overall screen with a high screen occupation ratio, an ultra-narrow edge frame, etc., can significantly improve a visual effect for a watcher, compared with a general display screen, and thus has been widely concerned. In order to display throughout the screen of a mobile phone as illustrated in FIG. 1, for example, four corners of a display region A are abnormally shaped regions C in which sub-pixels Px are arranged in a step-like distribution, thus resulting in a significant saw-tooth phenomenon at the edge of an image being displayed.

SUMMARY

An embodiment of the disclosure provides a display panel including a display region with at least one abnormally shaped region in which sub-pixels are arranged in a step-like distribution. At least opening regions of sub-pixels at the edges of the steps have a deflection angle of more than 0 degree and less than 180 degrees relative to opening regions of sub-pixels which are not located at the steps.

Correspondingly an embodiment of the disclosure further provides a display device including the display panel above according to the embodiment of the disclosure.

DETAILED DESCRIPTION OF THE EMBODIMENTS

Figure 1:
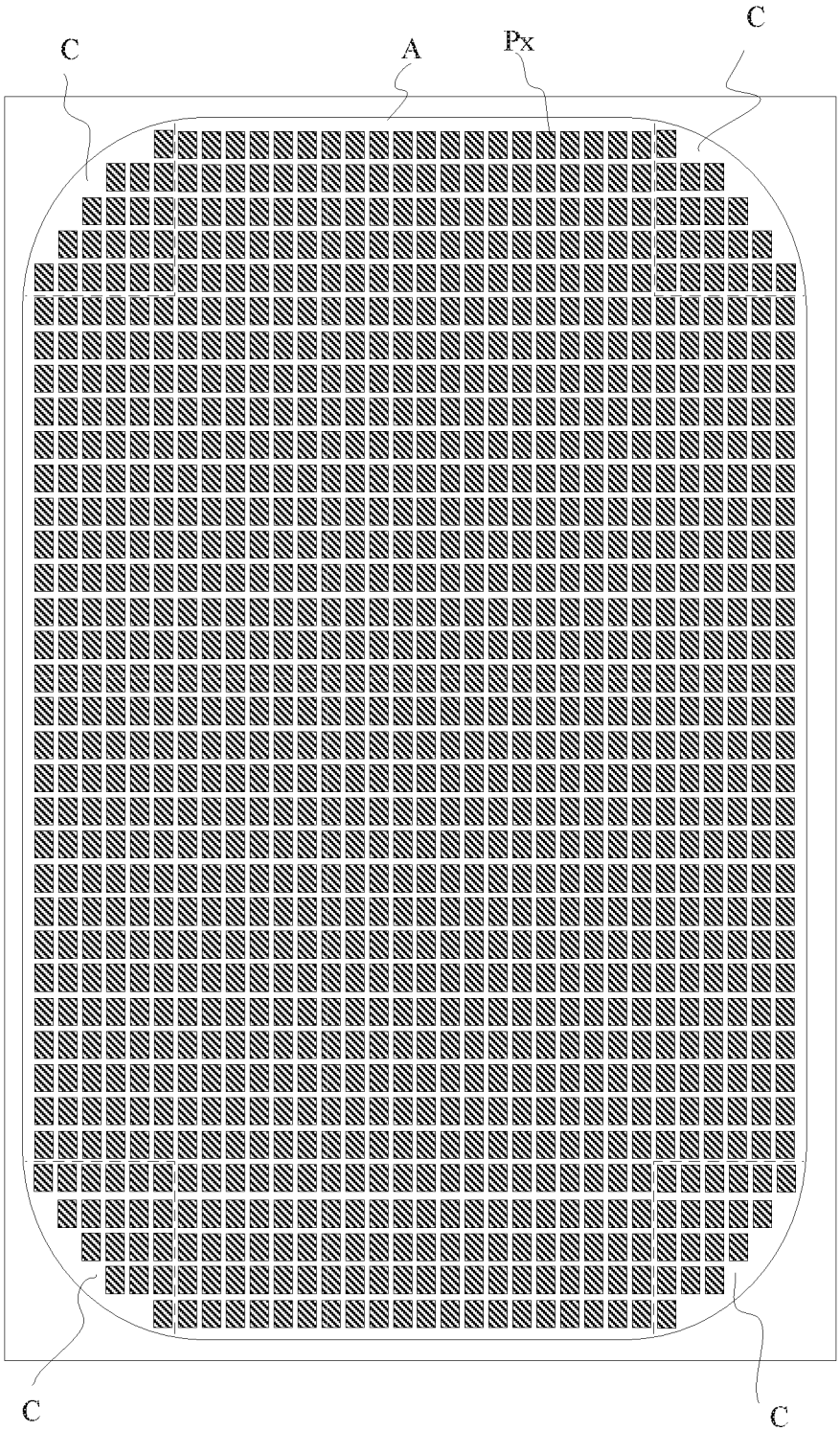
FIG. 1 is a schematic structural diagram of a display panel in the related art.

The embodiments of the disclosure provide a display panel and a display device. Implementations of the organic electroluminescent display panel, the method for manufacturing the same, and the display device according to the embodiments of the disclosure will be described below in details with reference to the drawings. It shall be appreciated that the ilk embodiments to be described below are merely intended to illustrate and describe the disclosure, but not to limit the disclosure thereto.

The shapes and sizes of respective components in the drawings are not intended to reflect any real proportion, but merely intended to illustrate the disclosure of the disclosure.

Figure 2:
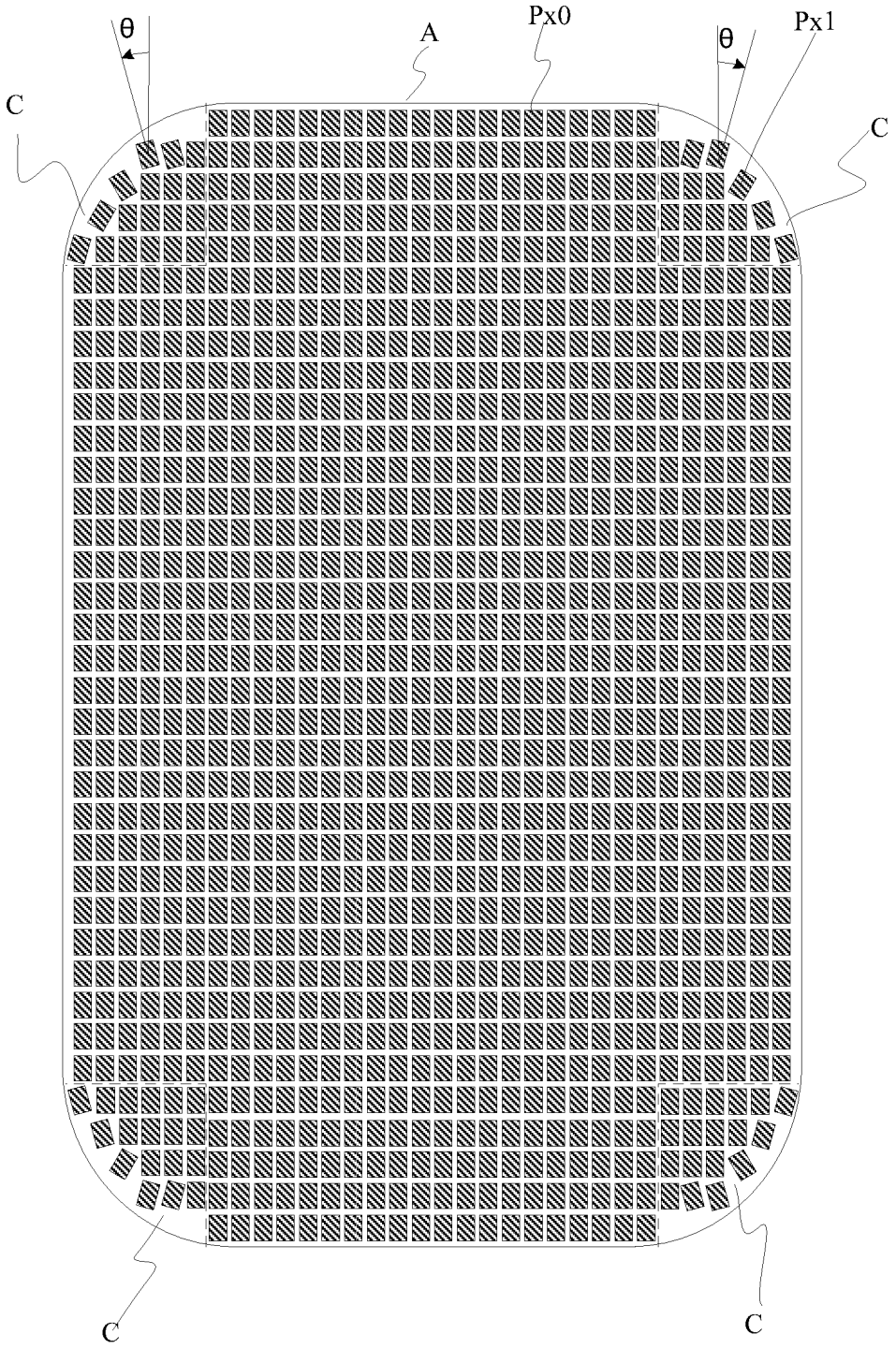
FIG. 2 is a schematic structural diagram of a display panel according to an embodiment of the disclosure.

Particularly in a display panel according to an embodiment of the disclosure, as illustrated in FIG. 2, there is at least one abnormally shaped region C (four abnormally shaped regions in FIG. 2, for example) in a display region of the display panel, and sub-pixels located in the abnormally shaped region C are arranged in a step-like distribution.

As illustrated in at least opening regions of sub-pixels Px1 at the edges of the steps have a deflection angle θ of more than 0 degree and less than 180 degrees relative to opening regions of sub-pixels Px0 which are not located at the steps.

Particularly a display region with a contour neither parallel to the extension line of the display panel in the row direction, nor parallel to the extension line of the display panel in the column direction can be defined as an abnormally shaped region. Therefore, in the display panel according to the embodiment of the disclosure, the contour of the abnormally shaped region is neither parallel to the extension line of the display panel in the row direction, nor parallel to the extension line of the display panel in the column direction.

In the display panel according to the embodiment of the disclosure, there is at least one abnormally shaped region in the display region, and the sub-pixels located in the abnormally shaped region are arranged in a step-like distribution, where at least the opening regions of the sub-pixels at the edges of the steps have a deflection angle of more than 0 degree and less than 180 degrees relative to opening regions of the sub-pixels which are not located at the steps. Since the contour of the abnormally shaped region in the display panel is neither parallel to the extension line of the display panel in the row direction, nor parallel to the extension line of the display panel in the column direction, but is generally a curve with a radian, the opening regions of the sub-pixels at the edges of the steps are deflected at some angle from the opening regions of the sub-pixels which are not located at the steps, so that there is a smaller angle between the contours of the deflected opening regions of the sub-pixels and the contour of the abnormally shaped region, thus alleviating a saw-tooth phenomenon at the edge of an image.

Figure 3A:
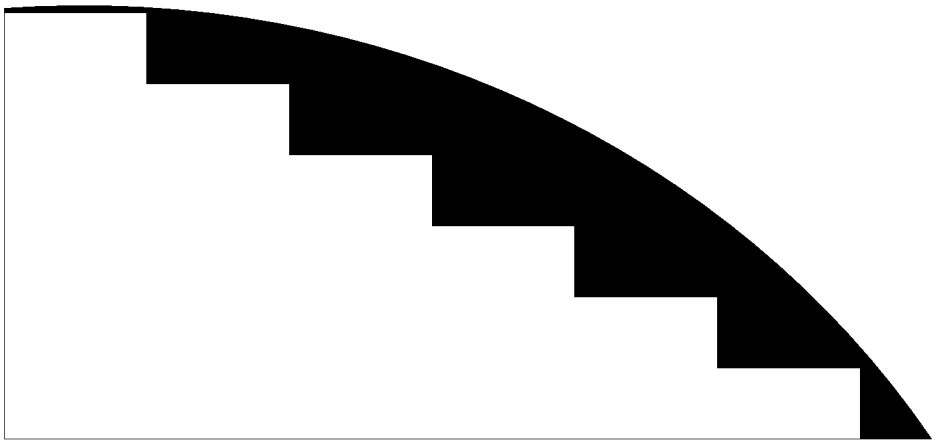
FIG. 3A is a schematic diagram of a saw-tooth phenomenon at the edge of an image on the display panel in the related art.
Figure 3B:
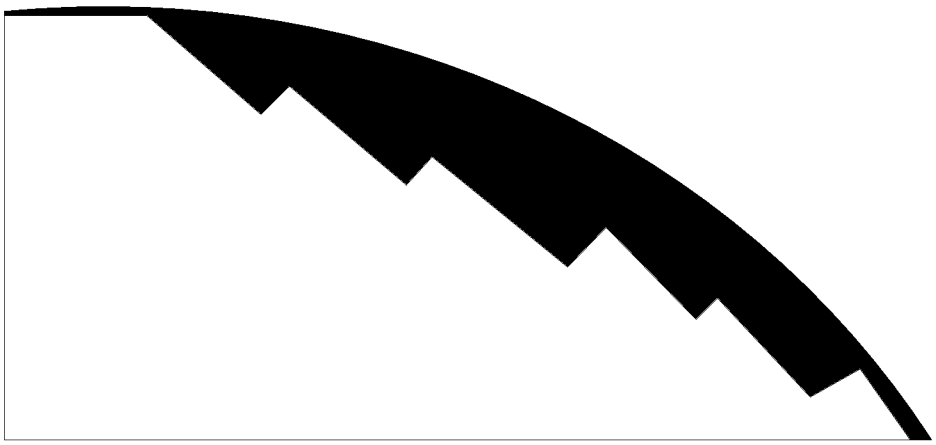
FIG. 3B is a schematic diagram of a saw-tooth phenomenon at the edge of an image on the display panel according to the embodiment of the disclosure.

Particularly in the display panel in the related art, the sub-pixels located in the abnormally shaped region are arranged in the same direction as the sub-pixels in the other regions, and the edge contours of the sub-pixels at the steps are generally parallel to the extension line of the display panel in the row direction, or parallel to the extension line of the display panel in the column direction, so there is a large angle between the edge contours of the sub-pixels at the steps and the contour of the abnormally shaped region. FIG. 3A illustrates a schematic diagram of the edge contour of an image being displayed (in white) and the contour of the abnormally shaped region (in black). In the display panel according to the embodiment of the disclosure, the opening regions of the sub-pixels at the edges of the steps are deflected at some angle from the opening regions of the sub-pixels which are not located at the steps, so that there is a smaller angle between the contours of the deflected opening regions of the sub-pixels and the contour of the abnormally shaped region. FIG. 3B illustrates a schematic diagram of the edge contour of the image being displayed (in white) and the contour of the abnormally shaped region (in black). As can be apparent from above comparison, a saw-tooth phenomenon at the edge of the image on the display panel according to the embodiment of the disclosure has been significantly alleviated.

Particularly in the display panel according to the embodiment of the disclosure, when the sub-pixels at the edges of the steps are deflected so that the contours of the opening regions of the sub-pixels are substantially parallel to the contour of the abnormally shaped region, there is the least saw-tooth phenomenon at the edge of the image.

Figure 4:
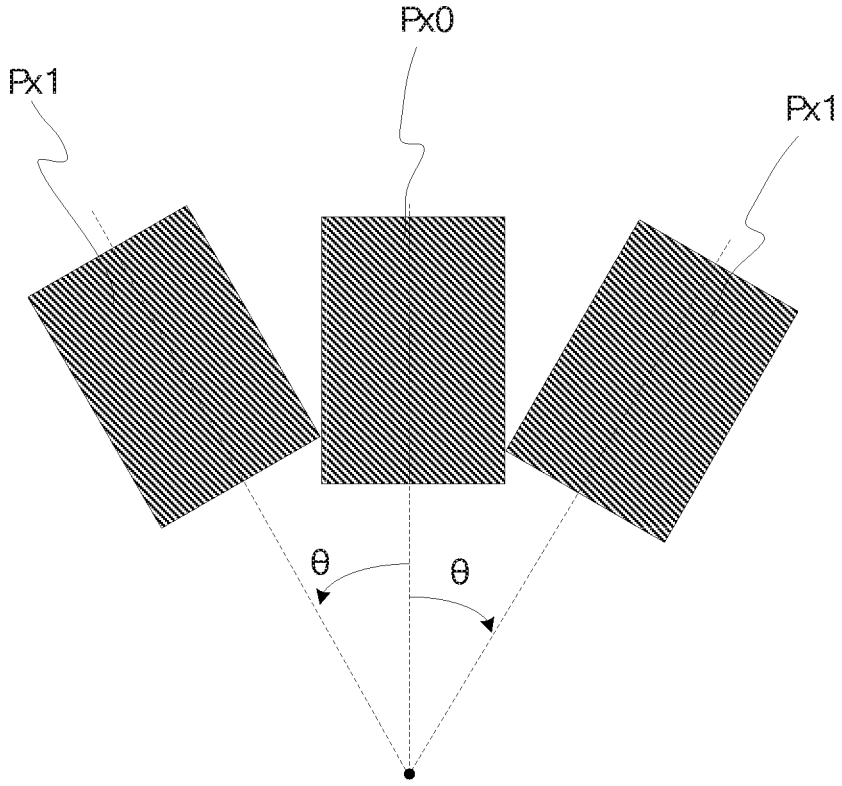
FIG. 4 is a schematic diagram of a deflection angle of a sub-pixel in the display panel according to the embodiment of the disclosure.

It shall be noted that in the display panel according to the embodiment of the disclosure, the opening regions of the sub-pixels at the edges of the steps have a deflection angle from the opening regions of the sub-pixels which are not located at the steps, where an axis perpendicular to the plane where the opening regions of the sub-pixels lie is a rotation axis, and the shapes of the opening regions of the sub-pixels which are not located at the steps after the opening regions of the sub-pixels are rotated by some angle around the rotation axis are the shapes of the opening regions of the sub-pixels at the edges of the steps. FIG. 4 merely illustrates a sub-pixel Px1 with a deflection angle θ by way of an example, where the sub-pixel Px1 at a step can be deflected clockwise at the deflection angle θ from a sub-pixel Px0 which is not located at the step, or, the sub-pixel Px1 can alternatively be deflected counterclockwise at the deflection angle θ from the sub-pixel Px0, although the embodiment of the disclosure will not be limited thereto.

Particularly in the display panel according to the embodiment of the disclosure, since the contour of the abnormally shaped region varies in position so that there is a varying angle of the tangent of the contour from the extension line of the display panel in the row direction, in order to alleviate the saw-tooth phenomenon at the edge of the image as much as possible, the deflection direction and the deflection angle of the sub-pixels can be designed according to their positions in the abnormally shaped region, so that the sides, of the opening regions of the sub-pixels at the steps, close to the contour of the abnormally shaped region are parallel to the tangent of the contour of the abnormally shaped region at corresponding positions as much as possible.

Particularly in the display panel according to the embodiment of the disclosure, since an area of a sub-pixel is relatively small, there are generally a plurality of sub-pixels at each step, and the edge contour of the displayed image is primarily determined by the contours of the opening regions of the sub-pixels close to the edges of the steps, so in the display panel according to the embodiment of the disclosure, the opening regions of the sub-pixels at the edges of the steps have a deflection angle from the opening regions of the sub-pixels which are not located at the steps. In another embodiment, the opening regions of all the sub-pixels at the steps have a deflection angle from the opening regions of the sub-pixels which are not located at the steps.

Particularly when the opening regions of the sub-pixels at the edges of the steps have a deflection angle from the sub-pixels which are not located at the steps, since a pixel is consisted of a plurality of sub-pixels while an image is being displayed, where a pixel is generally consisted of three RGB sub-pixels, in order to enable the sub-pixels of the same pixel to be arranged uniformly, in the display panel according to the embodiment of the disclosure, there is the same deflection angle of the respective sub-pixels of the same pixel.

Figure 5:
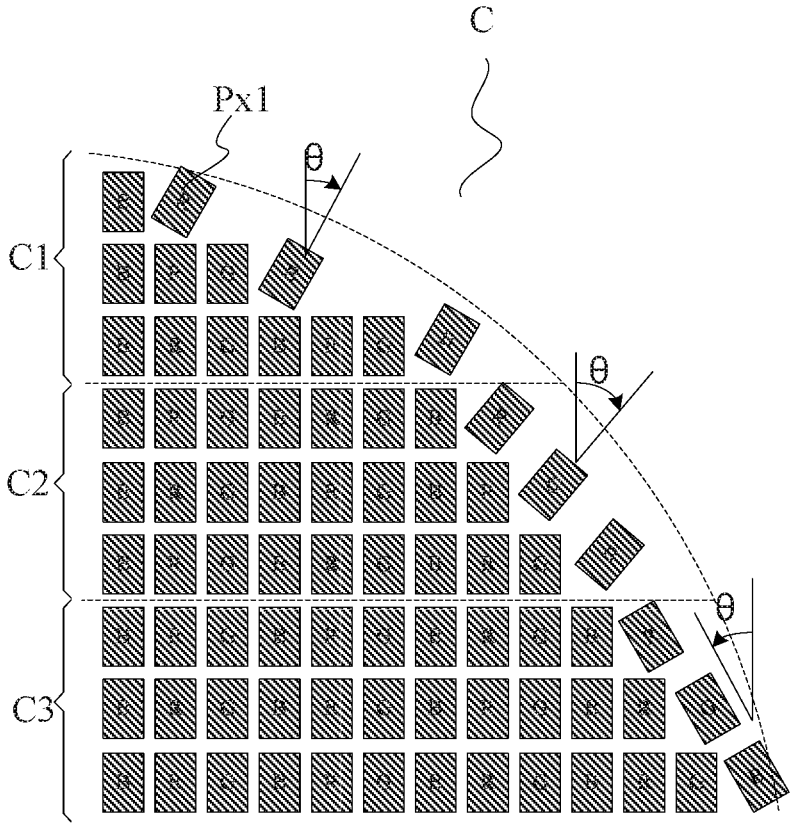
FIG. 5 is a schematic structural diagram of an arrangement of sub-pixels in an abnormally shaped region in the display panel according to the embodiment of the disclosure.
Figure 6:
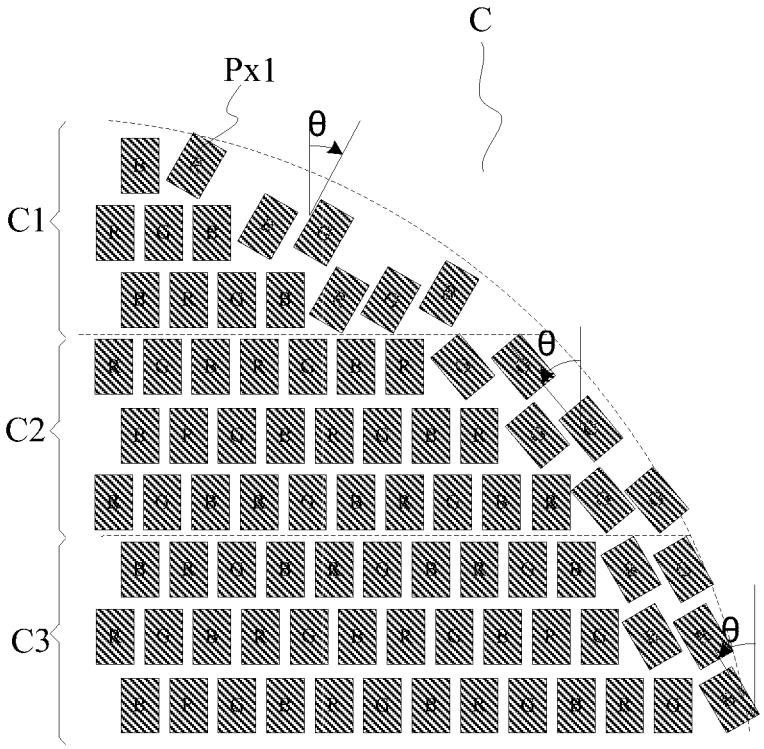
FIG. 6 is a schematic structural diagram of another arrangement of sub-pixels in an abnormally shaped region in the display panel according to the embodiment of the disclosure.

Particularly as illustrated in FIG. 5 and FIG. 6, the deflection angles of the sub-pixels at the steps in the display panel according to the embodiment of the disclosure will be described in details taking the contour of the abnormally shaped region being one fourth of a round as an example.

Particularly in the display panel according to the embodiment of the disclosure, the abnormally shaped region includes three sub-regions arranged in sequence in the column direction, where the three sub-regions are a first sub-region C1, a second sub-region C2, and a third sub-region C3 in that order in the column direction, and there is the shortest distance between the third sub-region C3 and the central line of the display panel extending in the row direction.

The deflection direction of the sub-pixels Px1 at the steps in the first sub-region C1 is opposite to the deflection direction of the sub-pixels Px1 at the steps in the third sub-region C3.

The deflection angle θ of the sub-pixels Px1 at the steps in the first sub-region C1 is smaller than or equal to the deflection angle θ of the sub-pixels Px1 at the steps in the second sub-region C2.

The deflection angle θ of the sub-pixels Px1 at the steps in the third sub-region C3 is smaller than or equal to the deflection angle θ of the sub-pixels Px1 at the steps in the second sub-region C2.

Particularly the angle between the edge contour of the first sub-region and the extension line of the display panel in the row direction does not exceed 45 degrees, the angle between the edge contour of the third sub-region and the extension line of the display panel in the column direction does not exceed 45 degrees, and the angle between the edge contour of the second sub-region and the extension line of the display panel in the row direction is approximately 45 degrees, in the abnormally shaped region.

Particularly in the display panel according to the embodiment of the disclosure, the deflection angle θ of the sub-pixels Px1 at the steps in the second sub-region C2 is the same as the deflection angle θ of the sub-pixels Px1 at the steps in the first sub-region C1 as illustrated in FIG. 5; or the deflection angle θ of the sub-pixels Px1 at the steps in the second sub-region C2 is the same as the deflection angle θ of the sub-pixels Px1 at the steps in the third sub-region C3 as illustrated in FIG. 6.

The display panel according to the embodiment of the disclosure is applicable to various existing pixel arrangement patterns with an edge saw-tooth, and particularly to a pixel arrangement structure in which sub-pixels are arranged in parallel in the row direction, or in which sub-pixels are arranged in parallel the column direction. For example, respective pixels consisted of three RGB sub-pixels are arranged repeatedly in the row direction, and there are sub-pixels in the same color in the column direction, as illustrated in FIG. 5, or respective pixels consisted of three RGB sub-pixels are arranged repeatedly in the row direction, and two adjacent rows of sub-pixels are arranged alternately, as illustrated in FIG. 6.

In one embodiment, in the display panel according to the embodiment of the disclosure, a deflection angle of the sub-pixels at the steps in the second sub-region is equal to 45 degrees.

In one embodiment, in the display panel according to the embodiment of the disclosure, there may be the same deflection angle θ of the sub-pixels Px1 at the steps in the same sub-region in an abnormally shaped region as illustrated in FIG. 5 and FIG. 6. However, in order to further alleviate the saw-tooth phenomenon at the edge of an image, deflection angles of sub-pixels in each sub-region can be further refined.

Particularly in the display panel according to the embodiment of the disclosure, every plurality of steps in each sub-region is defined as a group in an ascending or descending order of the steps, and deflection angles of sub-pixels are preset per group.

Figure 7:
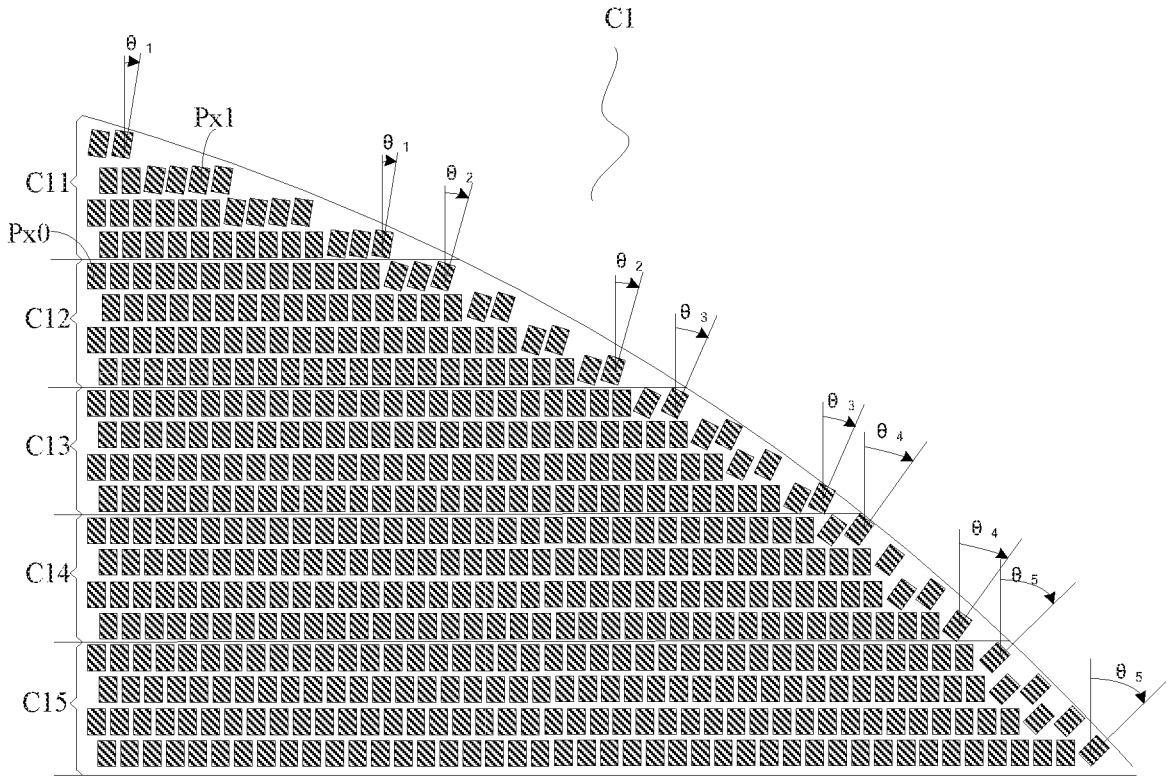
FIG. 7 is a schematic structural diagram of an arrangement of sub-pixels in a first sub-region in the display panel according to the embodiment of the disclosure.

In one embodiment, in the display panel according to the embodiment of the disclosure, as illustrated in FIG. 7, every x steps in the first sub-region C1 is defined as a step group, so the first sub-region C1 is divided into a plurality of step groups (C11 to C15 as illustrated in FIG. 7); and there is a larger deflection angle θ of sub-pixels at a step group at a shorter distance from the second sub-region, where x is an integer more than or equal to 1.

Figure 8:
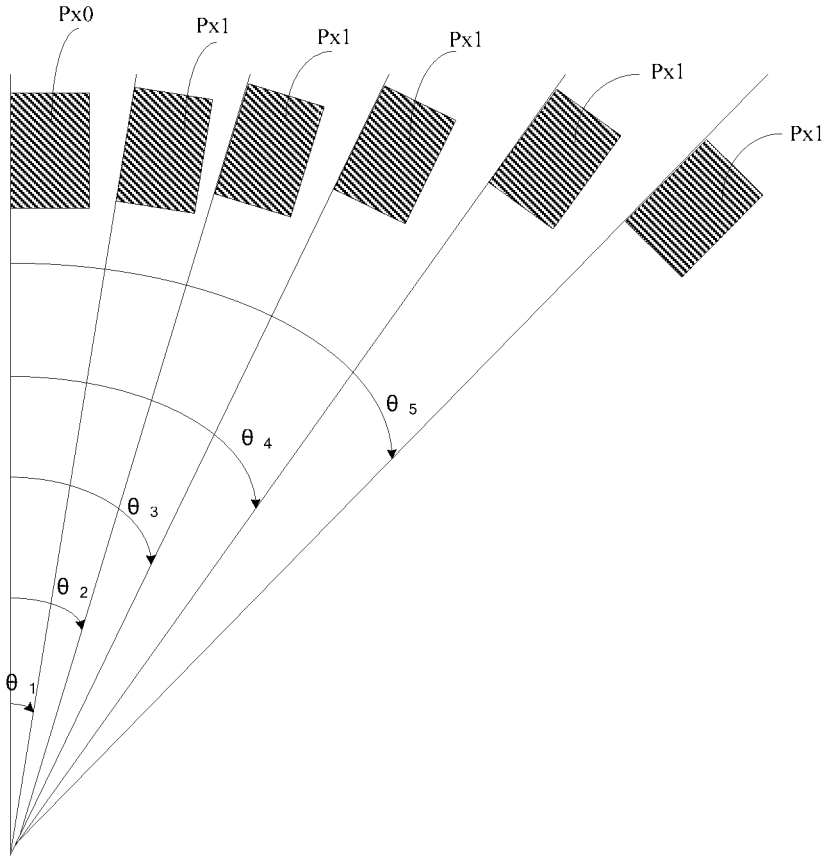
FIG. 8 is a schematic comparative diagram of deflection angles of sub-pixels in different step groups of sub-pixels in the first sub-region in the display panel according to the embodiment of the disclosure.

In one embodiment, in the display panel according to the embodiment of the disclosure, there is the same deflection angle θ of sub-pixels at the same step group in the first sub-region C1 as illustrated in FIG. 7. In FIG. 7, for example, there are the shortest distance of the step group C15 from the second sub-region, and the longest distance of the step group C11 from the second sub-region; and there are a deflection angle $\theta_1$ of the sub-pixels at the step group C11, a deflection angle $\theta_2$ of the sub-pixels at the step group C12, a deflection angle $\theta_3$ of the sub-pixels at the step group C13, a deflection angle $\theta_4$ of the sub-pixels at the step group C14, and a deflection angle $\theta_5$ of the sub-pixels at the step group C15, where $\theta_1<\theta_2<\theta_3<\theta_4<\theta_5$ as illustrated in FIG. 8.

In one embodiment, in the display panel according to the embodiment of the disclosure, the deflection angle of the sub-pixels increments by an equal difference between the respective step groups in the first sub-region, from the step group at the longest distance from the second sub-region, to the step group at the shortest distance from the second sub-region. In one embodiment, the difference between deflection angles of sub-pixels at two adjacent step groups can alternatively be predetermined according to the shapes of the contour of the abnormally shaped region at the respective step groups.

In one embodiment, in the display panel according to the embodiment of the disclosure, there are n step groups in the first sub-region, and there is a difference of 45/n degrees between deflection angles of sub-pixels at two adjacent step groups, where n is an integer more than 1. As illustrated in FIG. 7, for example, there are five step groups C11 to C15 in the first sub-region C1, and there are the shortest distance of the step group C15 from the second sub-region, and the longest distance of the group of step C11 from the second sub-region; and there are a deflection angle $\theta_1=9°$ of the sub-pixels at the step group C11, a deflection angle $\theta_2=18°$ of the sub-pixels at the step group C12, a deflection angle $\theta_3=27°$ of the sub-pixels at the step group C13, a deflection angle $\theta_4=36°$ of the sub-pixels at the step group C14, and a deflection angle $\theta_5=45°$ of the sub-pixels at the step group C15.

Particularly in the display panel according to the embodiment of the disclosure, in the abnormally shaped region, the angle between the edge contour of the first sub-region and the extension line of the display panel in the row direction does not exceed 45 degrees, and the angle between the edge contour of the third sub-region and the extension line of the display panel in the column direction does not exceed 45 degrees, so the deflection direction of the sub-pixels in the third sub-region is opposite to the deflection direction of the sub-pixels in the first sub-region. The same implementation principle as the deflection angles of the sub-pixels in the first sub-region may apply to the deflection angles of the sub-pixels in the third sub-region.

Figure 9:
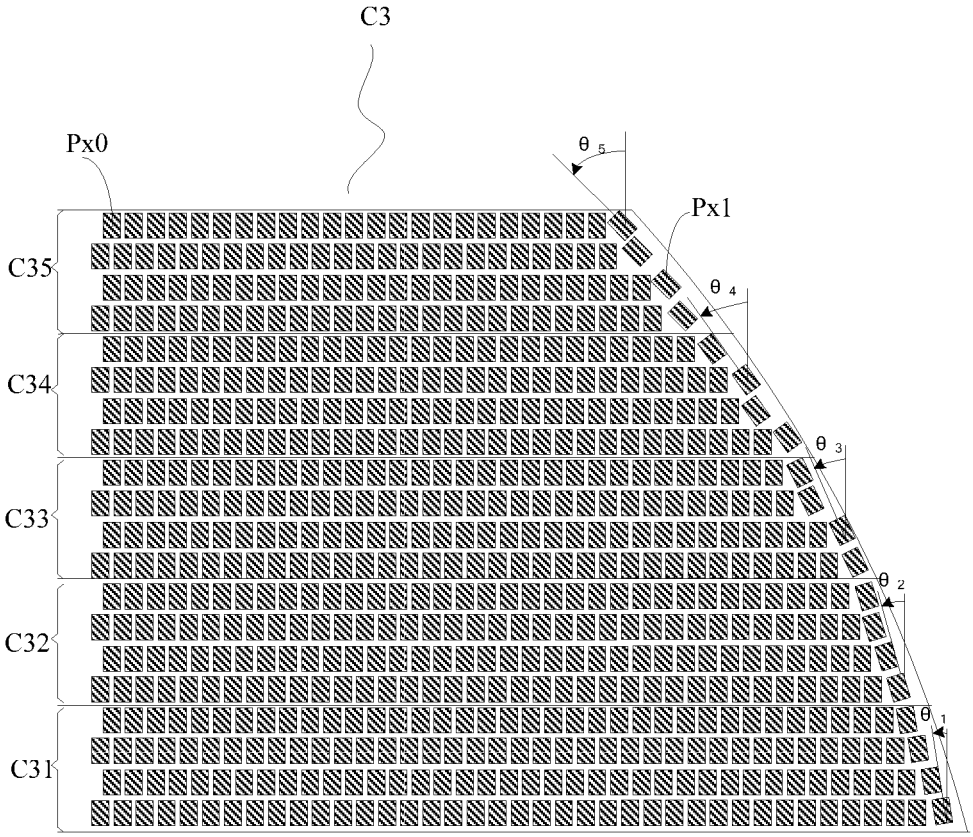
FIG. 9 is a schematic structural diagram of an arrangement of sub-pixels in a third sub-region in the display panel according to the embodiment of the disclosure.

In one embodiment, in the display panel according to the embodiment of the disclosure, as illustrated in FIG. 9, every y steps in the third sub-region C3 is defined as a step group, so the third sub-region C3 is divided into a plurality of step groups (C31 to C35 as illustrated in FIG. 9); and there is a smaller deflection angle θ of sub-pixels at a step group at a longer distance from the second sub-region, where y is an integer more than or equal to 1.

In one embodiment, in the display panel according to the embodiment of the disclosure, there is the same deflection angle of sub-pixels at the same step group in the third sub-region C3. In FIG. 9, for example, there are the longest distance of the step group C31 from the second sub-region, and the shortest distance of the step group C35 from the second sub-region; and there are a deflection angle $\theta_1$ of the sub-pixels at the step group C31, a deflection angle $\theta_2$ of the sub-pixels at the step group C32, a deflection angle $\theta_3$ of the sub-pixels at the step group C33, a deflection angle $\theta_4$ of the sub-pixels at the step group C34, and a deflection angle $\theta_5$ of the sub-pixels at the step group C35, where $\theta_1<\theta_2<\theta_3<\theta_4<\theta_5$ as illustrated in FIG. 9.

In one embodiment, in the display panel according to the embodiment of the disclosure, the deflection angle of the sub-pixels decrements by an equal difference between respective adjacent step groups in the third sub-region, from the step group at the shortest distance from the second sub-region, to the step group at the longest distance from the second sub-region. In one embodiment, the difference between deflection angles of sub-pixels at two adjacent step groups can alternatively be predetermined according to the shapes of the contour of the abnormally shaped region at the respective step groups.

In one embodiment, in the display panel according to the embodiment of the disclosure, there are m step groups in the third sub-region, and there is a difference of 45/m degrees between deflection angles of sub-pixels at two adjacent step groups, where m is an integer more than 1. As illustrated in FIG. 9, for example, there are five step groups C31 to C35 in the third sub-region C3, and there are the longest distance of the step group C31 from the second sub-region, and the shortest distance of the group of step C35 from the second sub-region; and there are a deflection angle $\theta_1=9°$ of the sub-pixels at the step group C31, a deflection angle $\theta_2=18°$ of the sub-pixels at the step group C32, a deflection angle $\theta_3=27°$ of the sub-pixels at the step group C33, a deflection angle $\theta_4=36°$ of the sub-pixels at the step group C34, and a deflection angle $\theta_5=45°$ of the sub-pixels at the step group C35.

In one embodiment, in the display panel according to the embodiment of the disclosure, the number of steps in the first sub-region is the same as the number of steps in the third sub-region. In one embodiment, the number of steps in the first sub-region and the number of steps in the third sub-region can alternatively be preset according to the ranges of the particular sub-regions, although the embodiment of the disclosure will not be limited thereto.

Particularly in the display panel according to the embodiment of the disclosure, the numbers of steps in the different sub-regions in the same abnormally shaped region may or may not be the same, although the embodiment of the disclosure will not be limited thereto.

In one embodiment, in the display panel according to the embodiment of the disclosure, there are the same numbers of steps in the three sub-regions in the abnormally shaped region.

Particularly in the display panel according to the embodiment of the disclosure, the widths of the respective steps are determined by the contour of the abnormally shaped region, and given a smaller angle between the side of a deflected opening region of a sub-pixel and a connecting line between the height and the width of the step, the side of the deflected opening region of the sub-pixel is more parallel to the connecting line, and there is a less saw-tooth phenomenon at the edge of the image.

Figure 10:
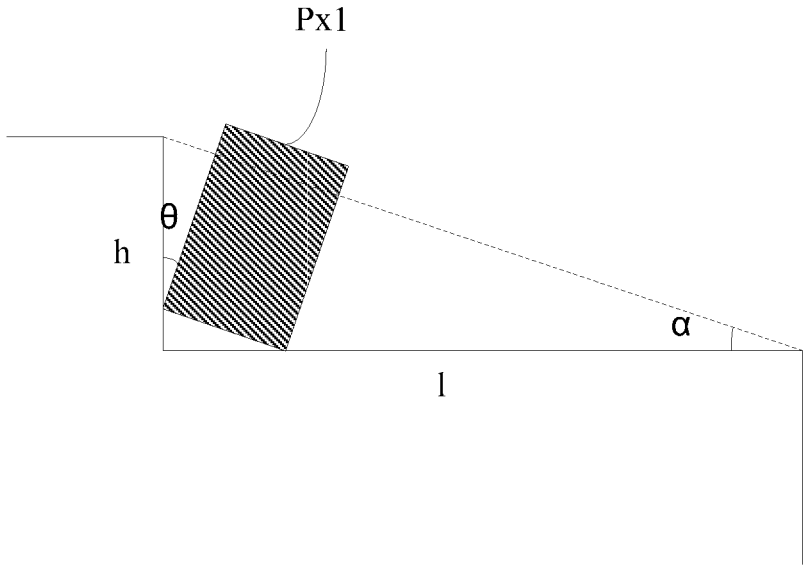
FIG. 10 is a schematic diagram of a deflection angle of a sub-pixel at a step and a reference angle corresponding to the step in the display panel according to the embodiment of the disclosure.

In view of this, in the display panel according to the embodiment of the disclosure, there is a difference of less than 10 degrees between the deflection angle $\theta$ of a sub-pixel Px1 at a step and a reference angle $\alpha$ corresponding to the step as illustrated in FIG. 10, where the reference angle $\alpha$ corresponding to the step is equal to arctan(h/l) with h being the height of the step and 1 being the width of the step.

In one embodiment, in the display panel according to the embodiment of the disclosure, the deflection angle $\theta$ of the sub-pixel Px1 at the step is equal to the reference angle $\alpha$ corresponding to the step as illustrated in FIG. 10.

It shall be noted that in the display panel according to the embodiment of the disclosure, the deflection angle of a sub-pixel refers to the deflection angle of an opening region of the sub-pixel.

Figure 11:
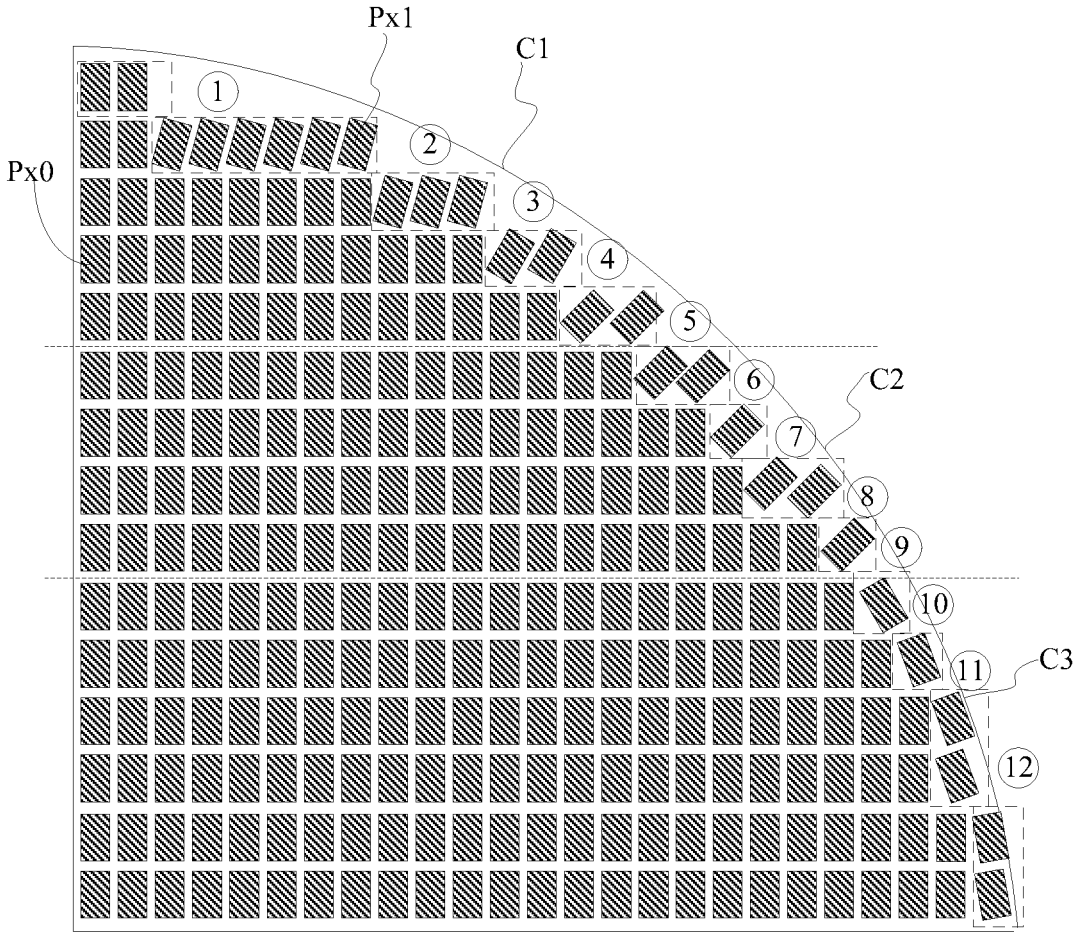
FIG. 11 is a schematic structural diagram of another arrangement of sub-pixels in an abnormally shaped region in the display panel according to the embodiment of the disclosure.

Particularly in the display panel according to the embodiment of the disclosure, a sub-pixel at a step refers to a sub-pixel located beyond an adjacent step, and as illustrated in FIG. 11, for example, there are five sub-pixels Px1 at a step ①, and three sub-pixels Px1 at a step ②.

Particularly the display panel according to the embodiment of the disclosure is an Organic Light-Emitting Diode (OLED) display panel. In the OLED display panel, a sub-pixel includes an anode, a light-emitting layer, and a cathode, which are arranged in a stack. The respective sub-pixels are driven by voltage provided from pixel circuits so that electrons and holes migrate respectively from the cathodes and the anodes to the light-emitting layers, meet each other at the light-emitting layers, are merged into excitons, and light-emitting molecules are excited by the excitons to emit visible light as a result of radiation and relaxation.

In one embodiment, in the display panel according to the embodiment of the disclosure, pixel circuits connected with the sub-pixels at the steps have the same deflection ilk angles as the deflection angles of their corresponding sub-pixels relative to pixel circuits connected with the sub-pixels which are not located at the steps.

Figure 12:
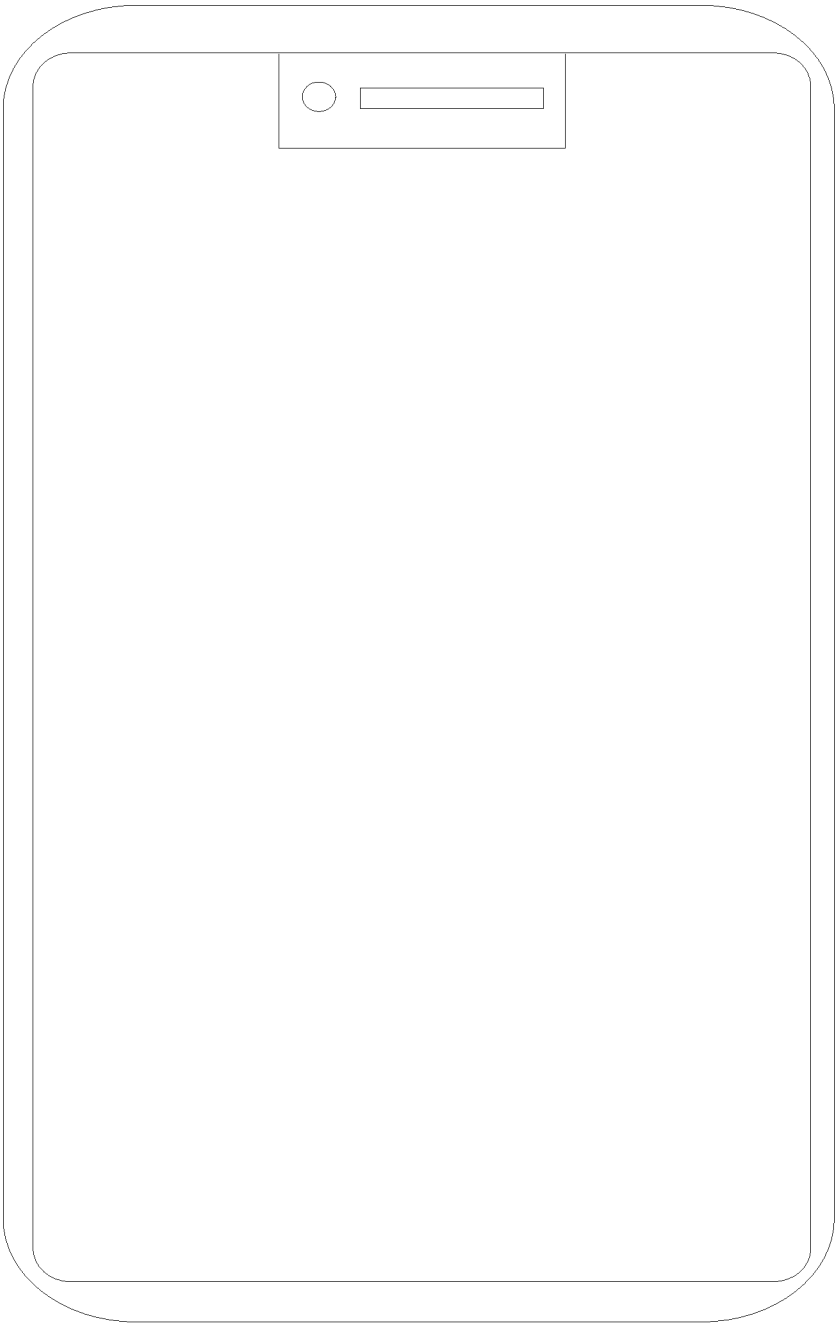
FIG. 12 is a schematic structural diagram of a display device according to an embodiment of the disclosure.

Based upon the same inventive idea, an embodiment of the disclosure further provides a display device as illustrated in FIG. 12, which includes the display panel above according to any one of the embodiments above of the disclosure. The display device addresses the problem under a similar principle to the display panel above, so reference can be made to the implementation of the display device for an implementation of the display device, and a repeated description thereof will be omitted here.

In a particular implementation, the display device according to the embodiment of the disclosure can be a mobile phone as illustrated in FIG. 12, or the display device according to the embodiment of the disclosure can alternatively be a tablet computer, a TV set, a monitor, a notebook computer, a digital photo frame, a navigator, or any other product or component with a display function.

In the display panel and the display device according to the embodiments of the disclosure, there is at least one abnormally shaped region in the display region, and the sub-pixels located in the abnormally shaped region are arranged in a step-like distribution, where at least the opening regions of sub-pixels at the edges of the steps have a deflection angle of more than 0 degree and less than 180 degrees relative to the opening regions of the sub-pixels which are not located at the steps. Since the contour of the abnormally shaped region in the display panel is neither parallel to the extension line of the display panel in the row direction, nor parallel to the extension line of the display panel in the column direction, but is generally a curve with a radian, the opening regions of the sub-pixels at the edges of the steps are deflected at some angle from the opening regions of the sub-pixels which are not located at the steps, so that there is a smaller angle between the contours of the deflected opening regions of the sub-pixels and the contour of the abnormally shaped region, thus alleviating a saw-tooth phenomenon at the edge of an image.

The invention claimed is:

1. A display panel, comprising:

a display region;

a plurality of sub-pixels arranged in the display region in parallel in a row direction and/or a column direction of the display panel; and at least one abnormally shaped region in the display region;

wherein:

a contour of the abnormally shaped region is neither parallel to an extension line of the display panel in the row direction, nor parallel to an extension line of the display panel in the column direction;

sub-pixels in the abnormally shaped region are arranged in a step-like distribution, a sub-pixel at a step refers to a sub-pixel located at least partially beyond an adjacent step, sides of any two steps closest to a non-display region are not in a line; and at least opening regions of sub-pixels at edges of steps having a deflection angle of more than 0 degree and less than 180 degrees relative to opening regions of sub-pixels which are not located at the steps; and wherein the abnormally shaped region comprises three sub-regions arranged in sequence in the column direction, wherein the three sub-regions are a first sub-region, a second sub-region, and a third sub-region in that order in the column direction, and a shortest distance between the third sub-region and a central line of the display panel extending in the row direction;

a deflection direction of sub-pixels at steps in the first sub-region is opposite to a deflection direction of sub-pixels at steps in the third sub-region, with respect to parallel reference lines extending in a same direction; every x steps in the first sub-region is defined as a step group, and there is the same deflection angle of sub-pixels at the same step group in the first sub-region, wherein x is an integer more than or equal to 1;

the deflection angle of the sub-pixels at the steps in the first sub-region is smaller than the deflection angle of the sub-pixels at the steps in the second sub-region; and the deflection angle of the sub-pixels at the steps in the third sub-region is smaller than the deflection angle of the sub-pixels at the steps in the second sub-region.

2. The display panel according to claim 1, wherein the deflection angle of the sub-pixels at the steps in the second sub-region is equal to 45 degrees.

3. The display panel according to claim 2, wherein a deflection angle of sub-pixels at a first step group in the first sub-region is larger than that of sub-pixels at a second step group in the first sub-region, wherein the first step group is at a shorter distance from the second sub-region than the second step group.

4. The display panel according to claim 3, wherein the deflection angle of the sub-pixels increments by an equal difference between the respective step groups in the first sub-region, from the step group at the longest distance from the second sub-region, to the step group at the shortest distance from the second sub-region.

5. The display panel according to claim 4, wherein there are n step groups in the first sub-region, and there is a difference of 45/n degrees between deflection angles of sub-pixels at two adjacent step groups, wherein n is an integer more than 1.

6. The display panel according to claim 2, wherein every y steps in the third sub-region is defined as a step group, and there is a smaller deflection angle of sub-pixels at a step group at a longer distance from the second sub-region, wherein y is an integer more than or equal to 1.

7. The display panel according to claim 6, wherein there is the same deflection angle of sub-pixels at the same step group in the third sub-region.

8. The display panel according to claim 7, wherein the deflection angle of the sub-pixels decrements by an equal difference between respective adjacent step groups in the third sub-region, from the step group at the shortest distance from the second sub-region, to the step group at the longest distance from the second sub-region.

9. The display panel according to claim 8, wherein there are m step groups in the third sub-region, and there is a difference of 45/m degrees between deflection angles of sub-pixels at two adjacent step groups, wherein m is an integer more than 1.

10. The display panel according to claim 1, wherein the number of steps in the first sub-region is the same as the number of steps in the third sub-region.

11. The display panel according to claim 10, wherein there are the same numbers of steps in the three sub-regions in the abnormally shaped region.

12. The display panel according to claim 1, wherein there is a difference of less than 10 degrees between a deflection angle $\theta$ of a sub-pixel at a step and a reference angle $\alpha$ corresponding to the step, wherein the reference angle $\alpha$ corresponding to the step is equal to arctan(h/1) with h being the height of the step and 1 being the width of the step.

13. The display panel according to claim 12, wherein the deflection angle of the sub-pixel at the step is equal to the reference angle corresponding to the step.

14. The display panel according to claim 1, wherein there is the same deflection angle of respective sub-pixels of the same pixel.

15. The display panel according to claim 1, wherein pixel circuits connected with the sub-pixels at the steps have the same deflection angles as the deflection angles of their corresponding sub-pixels relative to pixel circuits connected with the sub-pixels which are not located at the steps.

16. A display device, comprising:

a display panel, the display panel comprising a display region; a plurality of sub-pixels arranged in the display region in parallel in a row direction and/or a column direction of the display panel; and at least one abnormally shaped region in the display region;

wherein a contour of the abnormally shaped region is neither parallel to an extension line of the display panel in the row direction, nor parallel to an extension line of the display panel in the column direction; sub-pixels in the abnormally shaped region are arranged in a step-like distribution, a sub-pixel at a step refers to a sub-pixel located at least partially beyond an adjacent step, sides of any two steps closest to a non-display region are not in a line; and at least opening regions of sub-pixels at edges of steps have a deflection angle of more than 0 degree and less than 180 degrees relative to opening regions of sub-pixels which are not located at the steps; and wherein the abnormally shaped region comprises three sub-regions arranged in sequence in the column direction, wherein the three sub-regions are a first sub-region, a second sub-region, and a third sub-region in that order in the column direction, and a shortest distance between the third sub-region and a central line of the display panel extending in the row direction;

a deflection direction of sub-pixels at steps in the first sub-region is opposite to a deflection direction of sub-pixels at steps in the third sub-region, with respect to parallel reference lines extending in a same direction; every x steps in the first sub-region is defined as a step group, and there is the same deflection angle of sub-pixels at the same step group in the first sub-region, wherein x is an integer more than or equal to 1;

the deflection angle of the sub-pixels at the steps in the first sub-region is smaller than the deflection angle of the sub-pixels at the steps in the second sub-region; and the deflection angle of the sub-pixels at the steps in the third sub-region is smaller than the deflection angle of the sub-pixels at the steps in the second sub-region.

* * * * *